US007503355B2

(12) United States Patent
Bruna et al.

(10) Patent No.: US 7,503,355 B2
(45) Date of Patent: Mar. 17, 2009

(54) ASSEMBLY AND METHOD FOR MAKING, MOUNTING AND FILLING A FLUID PRODUCT DISPENSING DEVICE

(75) Inventors: Pascal Bruna, Sotteville les Rouen (FR); Dominique Hibon, Flexanville (FR); Herve Pacaud, L'Isle Adam (FR)

(73) Assignee: Valois S.A.S, Le Neubourg (FR)

( * ) Notice: Subject to any disclaimer, the term of this patent is extended or adjusted under 35 U.S.C. 154(b) by 333 days.

(21) Appl. No.: 10/470,377

(22) PCT Filed: Jan. 22, 2002

(86) PCT No.: PCT/FR02/00257

§ 371 (c)(1),
(2), (4) Date: Dec. 16, 2003

(87) PCT Pub. No.: WO02/060760

PCT Pub. Date: Aug. 8, 2002

(65) Prior Publication Data

US 2004/0079438 A1 Apr. 29, 2004

(30) Foreign Application Priority Data

Jan. 29, 2001 (FR) ..... 01 01143

(51) Int. Cl.
*B65B 1/04* (2006.01)

(52) U.S. Cl. ..... 141/85; 141/9; 141/20; 53/425; 53/452; 422/28; 422/308

(58) Field of Classification Search ..... 141/1–5, 141/9, 10, 20, 85; 53/242, 449, 452, 456, 53/469–471; 422/28, 302, 308
See application file for complete search history.

(56) References Cited

U.S. PATENT DOCUMENTS

| | | | | |
|---|---|---|---|---|
| 3,248,841 | A * | 5/1966 | Heffelfinger et al. | 53/426 |
| 3,745,741 | A * | 7/1973 | Cunningham et al. | 53/88 |
| 3,783,576 | A * | 1/1974 | Riesenberg et al. | 53/403 |
| 3,791,098 | A * | 2/1974 | Webster | 53/452 |
| 3,857,422 | A * | 12/1974 | Cunningham | 141/3 |
| 4,086,741 | A * | 5/1978 | Williams | 53/408 |
| 4,286,636 | A * | 9/1981 | Credle | 141/114 |
| 4,417,607 | A * | 11/1983 | Scholle et al. | 141/1 |
| 4,788,811 | A * | 12/1988 | Kawajiri et al. | 53/426 |
| 4,862,933 | A * | 9/1989 | Gies | 141/130 |
| 4,896,794 | A * | 1/1990 | Banks et al. | 222/1 |
| 4,992,247 | A * | 2/1991 | Foti | 422/304 |
| 5,001,878 | A * | 3/1991 | Sanfilippo et al. | 53/510 |
| 5,031,384 | A * | 7/1991 | Rebeyrolle et al. | 53/452 |
| 5,129,212 | A * | 7/1992 | Duffey et al. | 53/426 |
| 6,094,887 | A * | 8/2000 | Swank et al. | 53/426 |
| 6,120,730 | A * | 9/2000 | Palaniappan et al. | 422/28 |
| 6,196,275 | B1 * | 3/2001 | Yazawa et al. | 141/3 |

* cited by examiner

FOREIGN PATENT DOCUMENTS

FR 2 717 441 A 9/1995

*Primary Examiner*—Timothy L Maust
(74) *Attorney, Agent, or Firm*—Sughrue Mion, PLLC

(57) ABSTRACT

A facility for manufacturing, assembling, and filling a fluid dispenser device comprising a fluid reservoir (10) and a dispensing member (20), such as a pump or a valve, said facility being characterized in that it comprises a manufacturing unit for manufacturing a reservoir, a filling unit for filling said reservoir, and a fixing unit for fixing said dispensing member to said reservoir, said units operating continuously in a controlled atmosphere.

23 Claims, 3 Drawing Sheets

20
31
30
10

31
30
10

30

ASSEMBLY AND METHOD FOR MAKING, MOUNTING AND FILLING A FLUID PRODUCT DISPENSING DEVICE

The present invention relates to a method and a facility for manufacturing, assembling, and filling a fluid dispenser device.

Fluid dispenser devices are well known from the state of the art. In particular in the field of pharmaceuticals, it can be essential to guarantee absolute sterility for the fluid, i.e. the medication, to be dispensed. For this purpose, it is known that filters can be provided for air venting, and that actions of the bactericide type can be applied to the fluid being delivered, in particular at the dispensing orifice of the device. However, an essential condition is also to guarantee absolute sterility at the time of filling of the device.

Machines exist that enable a reservoir to be made, to be filled, and then to be closed, all of that being performed in a sterile controlled atmosphere. That type of machine, generally referred to as a Blow Fill Seal (BFS) machine is, for example, used for packaging physiological serum. Unfortunately, such BFS machines are not adapted to fixing a dispensing member, such as a pump or a valve, to the reservoir before or after filling.

It is also known that a reservoir, such as a syringe, can be pre-filled, and that the syringe can then be assembled into a dispenser device, the inside of the syringe being put into communication with the dispensing member at the time the device is used, and in particular by the stopper of the syringe being pierced. In which case, firstly drawbacks exist that are inherent to piercing an elastomer stopper, and secondly, since the pre-filled syringe is not assembled continuously in the controlled atmosphere, the sterility of the device, and in particular of the piercing needle is not guaranteed.

An object of the present invention is to provide a method and a facility for manufacturing, assembling, and filling a fluid dispensing device that does not reproduce the above-mentioned drawbacks.

Thus, an object of the present invention is to provide a method and a facility for manufacturing, assembling, and filling a fluid dispenser device that guarantees absolute sterility for the fluid contained inside the device, without any risk of contamination during any step of the process.

The present invention thus provides a facility for manufacturing, assembling, and filling a fluid dispenser device comprising a fluid reservoir and a dispensing member, such as a pump or a valve, said facility being characterized in that it comprises a manufacturing unit for manufacturing a reservoir, a filling unit for filling said reservoir, and a fixing unit for fixing said dispensing member to said reservoir, said units operating continuously in a controlled atmosphere.

Advantageously, the manufacturing unit is a unit for molding, overmolding, blowing, folding, sealing, and/or thermoforming.

Advantageously, the filling unit co-operates with the reservoir, with the dispensing member or with a filling element secured to said reservoir, and/or with said dispensing member.

Advantageously, the fixing unit for fixing the dispensing member is a snap-fastening, crimping, screw-fastening, sealing, or overmolding unit.

Advantageously, the facility further comprises a dispensing member assembly unit operating continuously in said controlled atmosphere with the other units.

The present invention also provides a method of making a fluid dispenser device comprising a reservoir and a dispensing member, such as a pump or a valve, said method being characterized in that it comprises the following steps:

a) providing a manufacturing unit for manufacturing a reservoir, a filling unit for filling said reservoir, and a fixing unit for fixing said dispensing member to said reservoir;

b) organizing said units and causing them to co-operate in a manner such that they operate continuously in a controlled atmosphere.

Advantageously, the units are organized in a manner such that the manufacturing unit makes the reservoir, then the filling unit fills it, and then the fixing unit fixes the dispensing member to the filled reservoir, all of this being performed in a controlled atmosphere.

In a variant, the units are organized in a manner such that the manufacturing unit makes the reservoir, then the fixing unit fixes the dispensing member to the empty reservoir, then the filling unit fills the reservoir.

Advantageously, the units are organized such that the manufacturing unit makes the reservoir, then the fixing unit pre-assembles the dispensing member to the reservoir, then the filling unit fills the reservoir, and then the fixing unit definitively fixes the dispensing member to the reservoir.

Advantageously, the filling unit co-operates with the dispensing member to fill the reservoir through said dispensing member.

Advantageously, the filling unit co-operates directly with the reservoir in order to fill it.

In a variant, said filling unit co-operates with an intermediate element secured to the reservoir and/or to the dispensing member.

Advantageously, said intermediate element is a flexible sleeve fixed in leaktight manner firstly to the reservoir and secondly to the dispensing member, and provided with a filling opening, said conical sleeve being manufactured and fixed to the reservoir by the manufacturing unit for manufacturing the reservoir, being fixed to the fixing member by the fixing unit while the dispensing member is being pre-assembled to the reservoir, and being deformed towards the inside of the reservoir by the fixing unit while the dispensing member is being definitively fixed to said reservoir.

In another implementation, the method further comprises a step of providing a dispensing member assembly unit that operates continuously in said controlled atmosphere with the other units.

Advantageously, the units are organized in a manner such that the dispensing member assembly unit makes the dispensing member, then the reservoir manufacturing unit makes a reservoir, then the fixing unit fixes said reservoir to said dispensing member, and then the filling unit fills said reservoir.

Advantageously, the reservoir manufacturing unit and the fixing unit co-operate to manufacture the reservoir on the assembled dispensing member in particular by overmolding.

Other characteristics and advantages of the present invention appear more clearly from the following detailed description of a particular implementation given by way of non-limiting example and with reference to the accompanying drawings, in which.

Figures 1, 2:
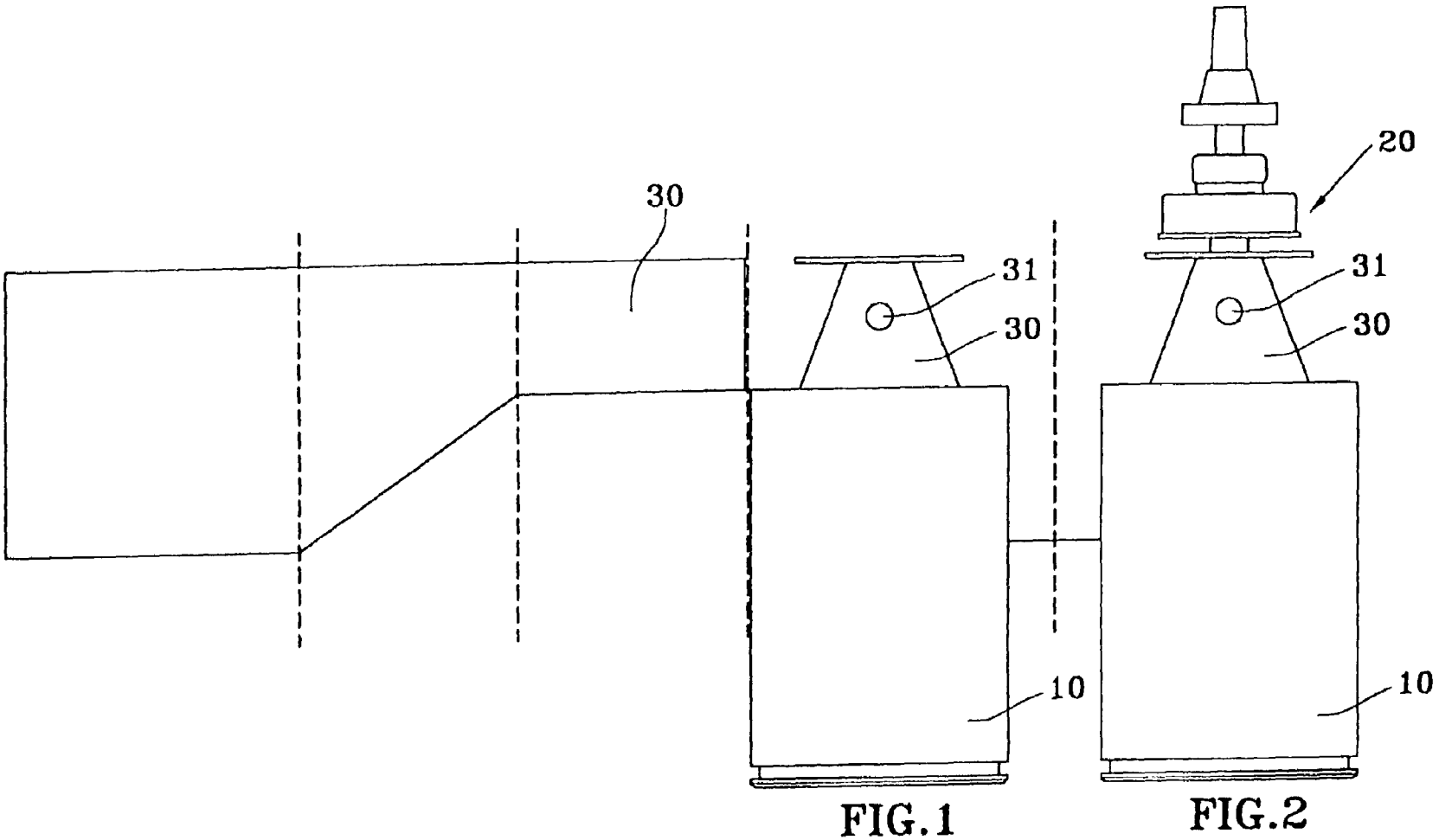
FIG. 1 is a diagrammatic view showing the steps in the process of manufacturing the reservoir, in a particular implementation of the present invention.
FIG. 2 is a diagrammatic view of the fluid dispenser device with the dispensing member pre-assembled to the reservoir, prior to filling.

The figures show a particular implementation of the invention. In this implementation, a facility is provided for manufacturing, assembling, and filling a fluid dispenser device which comprises a fluid reservoir 10 to which a dispensing member 20 such as a pump is assembled.

In the invention, the facility comprises a unit for manufacturing a reservoir 10, a unit for filling said reservoir 10, and a unit for fixing said pump 20 to said reservoir 10, said units operating continuously in a controlled atmosphere 40, and in particular under sterile conditions. Thus, the facility of the present invention makes it possible to perform all of the steps in the process of manufacturing, filling, and assembling the fluid dispenser device in the same controlled atmosphere without any interruption, thereby guaranteeing absolute sterility for the finished product.

As shown in the figures, which show a particular implementation, the reservoir 10 is advantageously formed of a rigid shell which is fixed to a conical and flexible filling element 30 that incorporates a filling opening 31.

FIG. 1 diagrammatically shows the process of manufacturing said filling element 30. Starting from a sheet, and in particular a sheet of aluminum, the reservoir manufacturing unit firstly folds said sheet of aluminum, and then contact points are bonded together to form a deformable conical sleeve, incorporating at least one filling opening 31. The sleeve 30 is then assembled onto the reservoir 10, which in this example is advantageously a rigid reservoir, also by means of the reservoir manufacturing unit.

Figure 3:
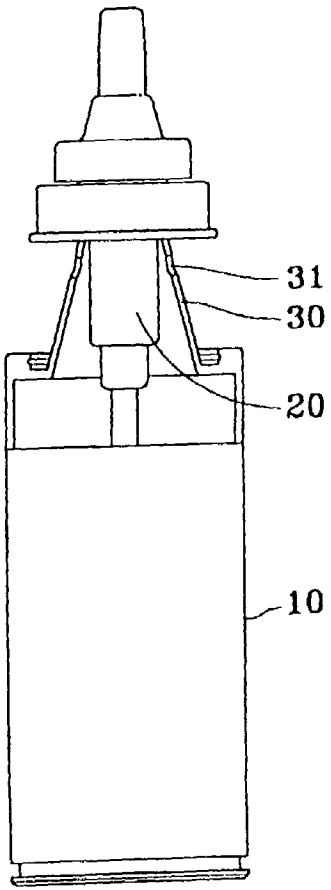
FIG. 3 is a view similar to the FIG. 2 view.

Advantageously, the dispenser member 20, which, in this example, is a pump, is then pre-assembled onto said filling element 30 by the unit for fixing the dispensing member to the reservoir. FIG. 2 shows the pre-assembled position, in which the filling element 30 connects the reservoir 10 to said dispensing member 20. Preferably, the filling element (in this example the conical sleeve 30) is fixed to the reservoir in leaktight manner, and similarly the dispensing member (in this example the pump 20) is pre-assembled to the conical sleeve 30 also in leaktight manner. The device in this pre-assembled position can also be seen in FIG. 3.

Figure 4:
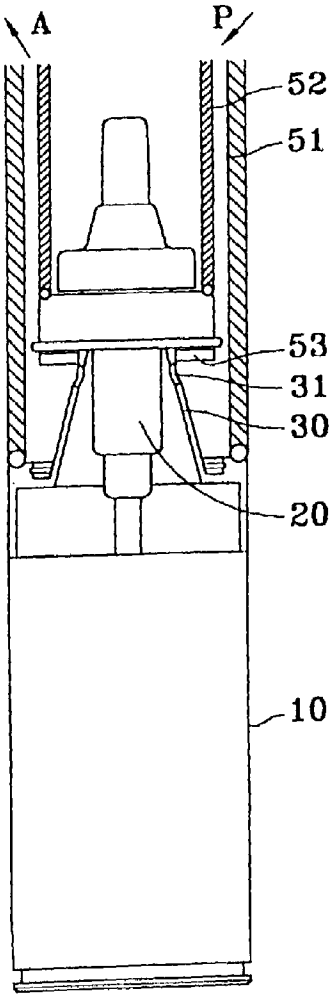
FIG. 4 is a view of the preceding device, during the filling process.

As shown in FIG. 4, the filling unit is then applied to the pre-assembled device. In the example shown in FIG. 4, said filling unit comprises an outer sleeve 51 which is applied in leaktight manner to the reservoir 10, and an inner sleeve 52 which is applied in leaktight manner to the dispensing member 20, which is held in the pre-assembled position by means of a support element 53 advantageously provided between the pump 20 and the reservoir 10. The filling unit then fills the reservoir 10 by injecting the fluid P between the sleeves 51 and 52, it then being possible for said fluid to penetrate into the reservoir through a filling orifice 31 provided in the conical sleeve 30. Simultaneously, the air A initially contained in the reservoir 10 can be released by exiting also via an orifice 31 in the sleeve 30 and by then being removed to the atmosphere by flowing between the two sleeves of the filling unit. The flexible conical filling element 30 may thus be provided with one or more filling orifices.

Figure 5:
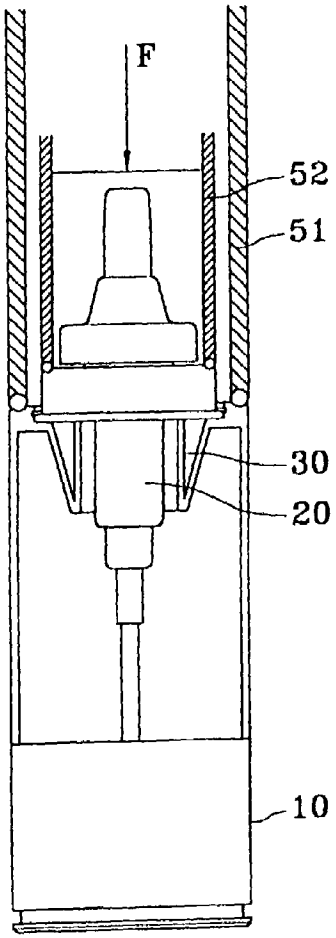
FIG. 5 is a view of the preceding device during the process of definitively fixing the dispensing member to the reservoir.

Once the device has been filled, a fixing unit for fixing the dispensing member 20 to the reservoir 10 then applies an axial force F to the dispensing member 20 so as to fix it to the reservoir 10. For this purpose, the support element 53 for supporting the filling unit is removed, and the force F may, for example, be applied to the pump 20 by the inner sleeve 52 of said filling unit, as shown in FIG. 5. The pump 20 is then moved towards the reservoir 10 so as to be fastened to the neck by any suitable means, e.g. snap-fastening, crimping, sealing, etc. The conical sleeve 30 is deformed towards the inside of the reservoir 10 during this process of fixing the pump 20, as can be seen clearly in FIG. 5.

Figure 6:
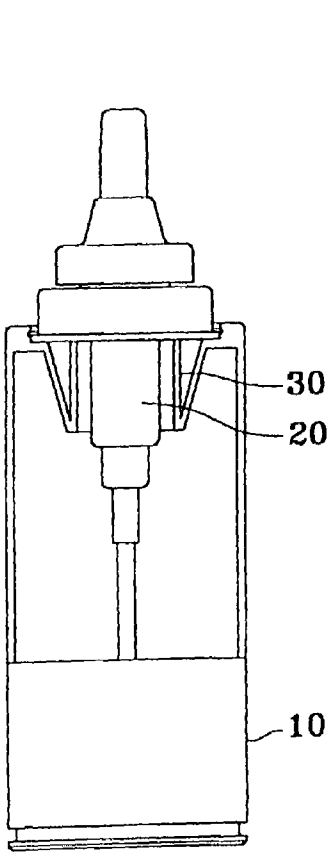
FIG. 6 is a diagrammatic view of the device as assembled and ready to use.

FIG. 6 shows the device as filled, assembled, and ready to use, which device may advantageously be packaged in a sterile bag so that, when the user wishes to use the device, said user is certain that there has been no interruption in the controlled atmosphere throughout the entire process of manufacturing, filling, and assembling the device.

Figure 7:
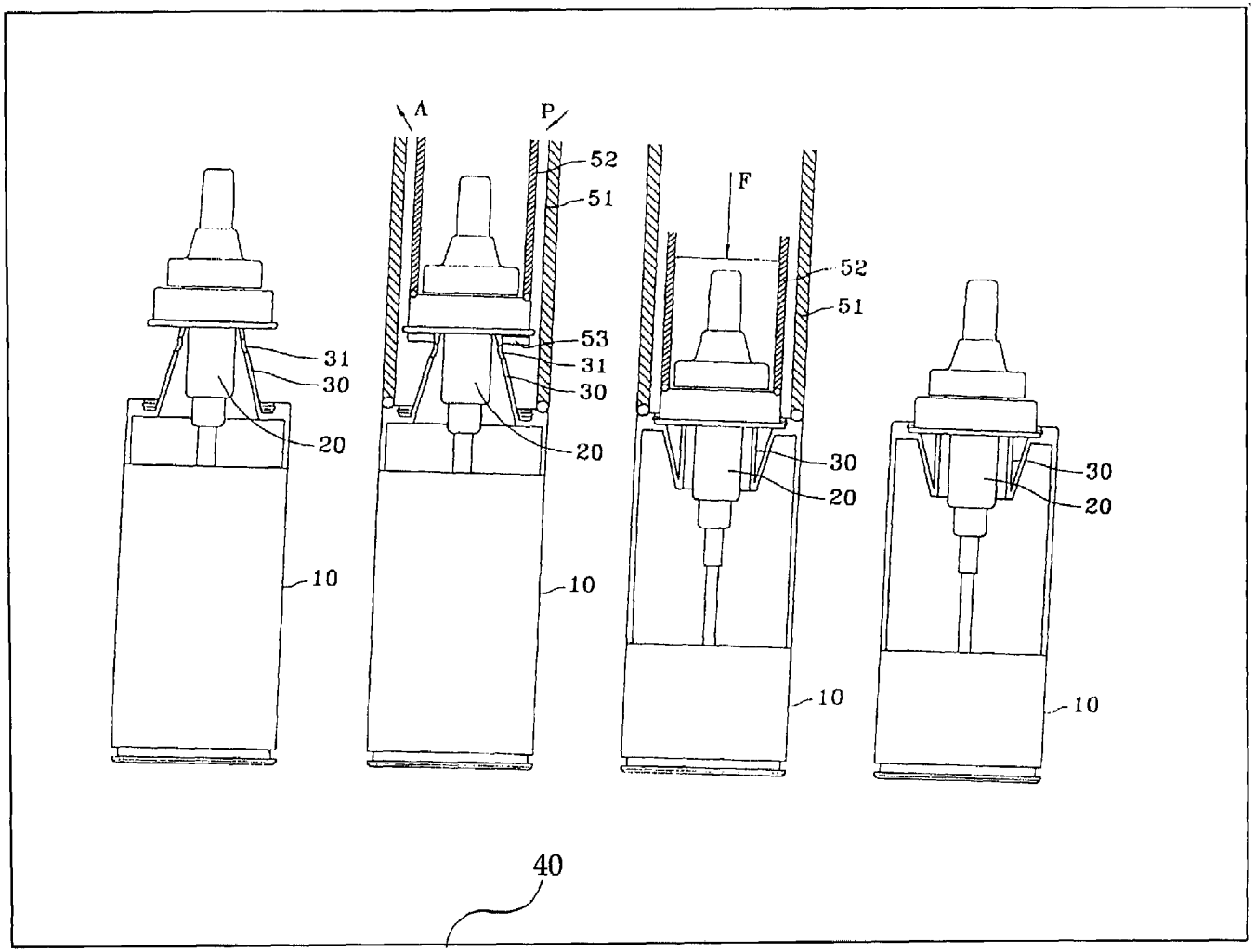
FIG. 7 is a diagrammatic view of the manufacturing and assembly steps of FIG. 3-6 in a continuously controlled environment.

FIG. 7 shows the manufacturing and assembling steps of FIGS. 3-6 in a continuously controlled atmosphere 40.

Naturally, the above-described manufacturing, assembling, and filling method and facility constitute merely an advantageous implementation of the invention. Numerous variants may be imagined for implementing the invention. In particular, the reservoir may be of any type, and is not necessarily constituted by a rigid shell. For example, the reservoir may be a flexible pouch, in particular made of aluminum, a blister pack, a thermoformed shell, a blown reservoir, in particular blown in a BFS machine, or any other reservoir that can be used in fluid dispenser devices. Similarly, the presence of the filling element 30 is not necessary, it being possible for the filling unit to co-operate either directly with the dispensing member 20 so as to fill the reservoir therethrough, or directly with a filling orifice provided in the reservoir 10, e.g. through the bottom of said reservoir. In addition, the chronological order of the steps in the manufacturing, assembling, and filling method is not necessarily as described in the example given with reference to the figures. Thus, the filling unit may fill the reservoir before the dispensing member is assembled or pre-assembled thereto. Similarly, the dispensing member may be fully assembled to the empty reservoir, and then the device may be filled, either directly through an orifice provided in the reservoir, or through the dispensing member as mentioned above. Another variant is to provide a dispensing member assembly unit which also operates continuously in a controlled atmosphere, with the other above-described units. Such a dispensing member assembly unit may then make the dispensing member, (the pump in this example), and then the reservoir may be fixed to said pump by the fixing unit before the device is filled by the filling unit. In this variant, the unit for manufacturing the reservoir, and the unit for fixing the dispensing member to the reservoir may co-operate so as to cause the reservoir to be fixed directly, e.g. by overmolding, to the pump assembled by the dispensing member assembly unit.

The essential characteristic of the present invention is for all of the processes of manufacturing, assembling, and filling a fluid dispenser device, in particular for dispensing a pharmaceutical, to be performed in a controlled atmosphere, and in particular under sterile conditions. The order of the steps, the configurations of the various units, and the particular shapes of the component portions of the device are not limiting, and the person skilled in the art may make various modifications to the method and facility described with reference to the figures, without going beyond the ambit of the present invention, as defined by the accompanying claims.

The invention claimed is:

1. A facility for manufacturing, assembling, and filling a fluid dispenser device comprising a fluid reservoir (10) and a dispensing member (20), said facility comprising a manufacturing unit for manufacturing a reservoir, a filling unit for filling said reservoir with a fluid, and a fixing unit for fixing said dispensing member to said reservoir, said units operating continuously in sterile conditions;

wherein the dispensing member comprises at least one of a pump and a valve;

wherein the fluid is in direct contact with the reservoir following filling of the reservoir; and wherein the reservoir containing the fluid is a rigid shell.

2. A facility according to claim 1, in which the manufacturing unit is a unit for molding, overmolding, blowing, folding, sealing, and/or thermoforming.

3. A facility according to claim 1, in which facility the filling unit co-operates with the reservoir (10), with the dispensing member or with a filling element (30) secured to said reservoir (10), and/or with said dispensing member (20).

4. A facility according to claim 1, in which the fixing unit for fixing the dispensing member (20) is a snap-fastening, crimping, screw-fastening, sealing, or overmolding unit.

5. A facility according to claim 1, further comprising a dispensing member assembly unit operating continuously in said controlled atmosphere with the other units.

6. A facility according to claim 1, wherein the filling unit fills said reservoir with a medication.

7. A method of making a fluid dispenser device comprising a reservoir (10) and a dispensing member (20), said method being characterized in that it comprises the following steps:

a) providing a manufacturing unit for manufacturing a reservoir, a filling unit for filling said reservoir with a fluid, and a fixing unit for fixing said dispensing member to said reservoir;

b) organizing said units and causing them to co-operate in a manner such that they operate continuously in sterile conditions;

wherein the dispensing member comprises at least one of a pump and a valve;

wherein the fluid is in direct contact with the reservoir following filling of the reservoir; and wherein the reservoir containing the fluid is a rigid shell.

8. A method according to claim 7, in which the units are organized in a manner such that the manufacturing unit makes the reservoir (10), then the filling unit fills it, and then the fixing unit fixes the dispensing member (20) to the filled reservoir, all of this being performed in a controlled atmosphere.

9. A method according to claim 7, in which the units are organized in a manner such that the manufacturing unit makes the reservoir (10), then the fixing unit fixes the dispensing member (20) to the empty reservoir, then the filling unit fills the reservoir (10).

10. A method according to claim 7, in which the units are organized such that the manufacturing unit makes the reservoir (10), then the fixing unit pre-assembles the dispensing member (20) to the reservoir (10), then the filling unit fills the reservoir (10), and then the fixing unit definitively fixes the dispensing member (20) to the reservoir (10).

11. A method according to claim 9, in which the filling unit co-operates with the dispensing member (20) to fill the reservoir (10) through said dispensing member (20).

12. A method according to claim 9, in which the filing unit co-operates directly with the reservoir (10) in order to fill it.

13. A method according to claim 9, in which the filing unit co-operates with an intermediate element (30) secured to the reservoir (10) and/or to the dispensing member (20).

14. A method according to claim 13, in which said intermediate element (30) is a flexible sleeve fixed in leaktight manner firstly to the reservoir (10) and secondly to the dispensing member (20), and provided with a filling opening (31), said conical sleeve (30) being manufactured and fixed to the reservoir (10) by the manufacturing unit for manufacturing the reservoir, being fixed to the fixing member (20) by the fixing unit while the dispensing member (20) is being pre-assembled to the reservoir (10), and being deformed towards the inside of the reservoir (10) by the fixing unit while the dispensing member (20) is being definitively fixed to said reservoir (10).

15. A method according to claim 7, further comprising a step of providing a dispensing member assembly unit that operates continuously in said controlled atmosphere with the other units.

16. A method according to claim 15, in which the units are organized in a manner such that the dispensing member assembly unit makes the dispensing member (20), then the reservoir manufacturing unit makes a reservoir (10), then the fixing unit fixes said reservoir to said dispensing member (20), and then the filling unit fills said reservoir (10).

17. A method according to claim 16, in which the reservoir manufacturing unit and the fixing unit co-operate to manufacture the reservoir (10) on the assembled dispensing member (20).

18. A method according to claim 7, wherein the filling unit fills said reservoir with a medication.

19. A method according to claim 18, in which the reservoir manufacturing unit and the fixing unit co-operate to manufacture the reservoir on the assembled dispensing member by overmolding.

20. A method of making a fluid dispenser comprising:

manufacturing a fluid dispenser reservoir;

filling the fluid dispenser reservoir with a fluid; and fixing a dispensing member to the fluid dispenser reservoir;

wherein the steps of manufacturing, filling and fixing are performed continuously in a controlled atmosphere;

wherein the controlled atmosphere comprises sterile conditions;

wherein the dispensing member comprises at least one of a pump and a valve;

wherein the fluid is in direct contact with the reservoir following filling of the reservoir; and wherein the reservoir containing the fluid is a rigid shell.

21. A method of making a fluid dispenser according to claim 20, wherein the fluid dispenser reservoir is filled with a medication.

22. A facility for making a fluid dispenser device comprising:

a manufacturing unit which manufactures a fluid dispenser reservoir;

a filling unit which fills the fluid dispenser reservoir with a fluid; and a fixing unit which fixes a dispensing member to the fluid dispenser reservoir;

wherein manufacturing, filling and fixing units operate continuously in a controlled atmosphere;

wherein the controlled atmosphere comprises sterile conditions;

where in the dispensing member comprises at least one of a pump and a valve;

wherein the fluid is in direct contact with the reservoir following filling of the reservoir; and wherein the reservoir containing the fluid is a rigid shell.

23. A facility according to claim 22, wherein the filling unit fills the fluid dispenser reservoir with a medication.

* * * * *